US010350747B2

(12) United States Patent
Weng

(10) Patent No.: US 10,350,747 B2
(45) Date of Patent: Jul. 16, 2019

(54) DYNAMIC TOOLBOX

(71) Applicant: Lin Lin Weng, Yangzhou (CN)

(72) Inventor: Lin Lin Weng, Yangzhou (CN)

( * ) Notice: Subject to any disclaimer, the term of this patent is extended or adjusted under 35 U.S.C. 154(b) by 378 days.

(21) Appl. No.: 15/390,940

(22) Filed: Dec. 27, 2016

(65) Prior Publication Data

US 2018/0178371 A1 Jun. 28, 2018

(51) Int. Cl.
*B25H 3/00* (2006.01)
*B25H 3/02* (2006.01)

(52) U.S. Cl.
CPC ..... *B25H 3/028* (2013.01)

(58) Field of Classification Search
CPC . B25H 3/028; B25H 3/04; B25H 3/06; B25H 3/00; B25H 3/022; B25H 3/025–028; B25B 13/56
USPC ..... 206/372, 373, 379
See application file for complete search history.

(56) References Cited

U.S. PATENT DOCUMENTS 4,294,348 A * 10/1981 Hastings ..... A45C 11/24 206/1.7
5,544,744 A * 8/1996 Oman ..... B25H 3/028 206/319
5,788,072 A * 8/1998 Chen ..... B25H 3/026 206/372
2006/0278635 A1* 12/2006 Hu ..... B25H 3/003 220/4.22

* cited by examiner

*Primary Examiner* — Anthony D Stashick
*Assistant Examiner* — Raven Collins
(74) *Attorney, Agent, or Firm* — Jie Tan; JT Law Services, PC

(57) ABSTRACT

A dynamic toolbox that is capable of being disassembled has two pull-out side tool racks and two pop-out lift-racks. The toolbox is configured with multiple triangular apertures that provide sufficient supporting strength but eliminate unnecessary material weight.

8 Claims, 12 Drawing Sheets

DYNAMIC TOOLBOX

DESCRIPTION OF RELATED ART

The present application relates generally to toolboxes for organizing tools, and more specifically to a toolbox that is assembled together with disassemble-able racks and arms as well as supporting frames with void inside and multiple apertures in reducing unnecessary weight.

Note that the points discussed below may reflect the hindsight gained from the disclosed inventions, and are not necessarily admitted to be prior art.

Many mechanic tools are very specialized in use and increasingly more tools are being designed for special uses and purposes. Managing tools in organized ways can save time and increase efficiency. Mechanics in factories and auto repair shops, handy home owners and users of outdoor facilities simply accommodated the need by using heavy compartmentation and adding drawers to store different categories of tools. However, the increase in the number of drawers significantly adds to the weight of a toolbox. The mere heavy weight of an empty toolbox itself exacerbates the problem of carrying heavy tools to a job site.

However, there have not been many innovations for toolbox designs for storing mechanic tools. A few design innovation examples are found in the U.S. Pat. No. 5,429,235 where a tool box assembly is designed to have a main case with two main casing halves. U.S. Pat. No. 6,237,451 attempts to provide a solution by providing a small tool box in cylindrical shape with multiple accesses to tools. Most of the designs are focused on providing a toolbox that allows for better tool accessibility and tool organization, minimizing the weight of a toolbox seems to have been ignored.

There is a great need for a toolbox design that not only provides great flexibility and good organization for tools but also reduces unnecessary toolbox weight.

SUMMARY

The present application discloses a novel dynamic toolbox that can be disassembled and assembled during use and is distinctly designed to include many void and apertures to eliminate unnecessary weight.

In one embodiment, a toolbox for holding wrench set or other similar heavy duty tools, includes a holding frame having quartered sections, with two opposing sections being symmetric in shape to each other. Two of the opposing sections are shaped like head-to-head three dimensional spanning-wings for providing a standing support for the whole toolbox; the other two opposing sections comprise two bottom-boards that are each configured with a pair of horizontal sliding tracks for holding-in two sliding-rack-panels that have rack clamps for holding tools.

In one embodiment, a section wall is configured in the middle of the toolbox separating the two bottom-boards, the section wall is configured with a vertical pocket on each side for each glidingly mounting a heavy-duty continuous hinge fin that has a built-in spring mechanism at the hinge joint section to each support a hinged lift-rack-arm that can hold tools on its clamps.

In one embodiment, two lift-rack-arms built with multiple tool-holding clamp sets are hinged to the heavy-duty continuous hinge fins that will be propelled upwards out of the vertical holding pocket by the spring mechanism at the hinge joint, allowing the lift-rack-arms to spring upwards in the air for easy access to the tools on the rack. The two lift-rack-arms are configured in size to match the sliding-racks.

In one embodiment, matching locking mechanisms are configured at the free ends of the lift-rack-arms and the sliding-rack-panels, so that the lift-rack-arms effectively function as the box cover for the toolbox.

The disclosed innovation, in various embodiments, provides the advantages of being heavy duty yet light weight. Its disassembly capacity enables the boxed tools to be accessed with high level of ease.

BRIEF DESCRIPTION OF THE DRAWINGS

The disclosed application will be described with reference to the accompanying drawings, which show sample embodiments of the invention and which are incorporated in the specification hereof by reference, wherein.

DETAILED DESCRIPTION OF SAMPLE EMBODIMENTS

Figure 1A:
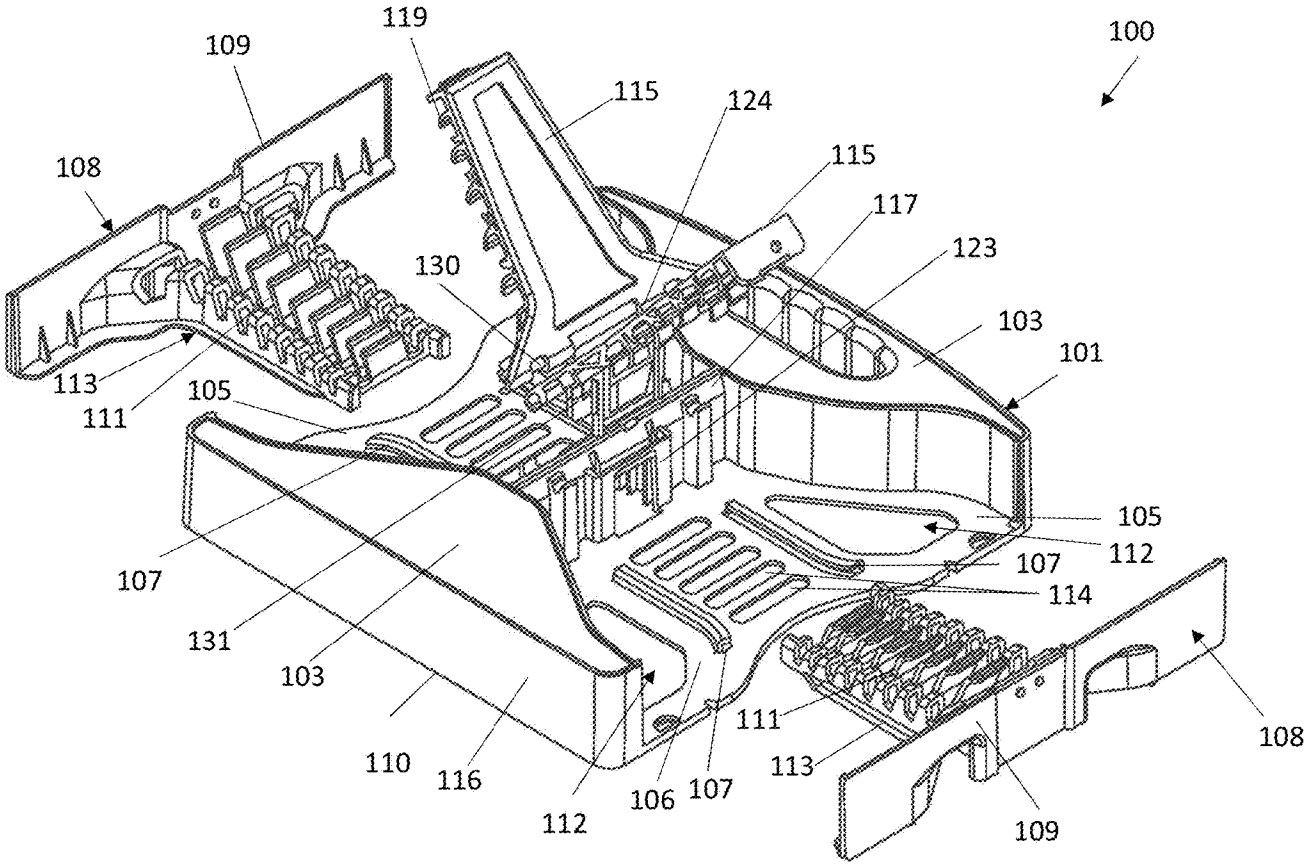
FIG. 1A is a perspective view of an example functioning empty toolbox in accordance with this application.

The numerous innovative teachings of the present application will be described with particular reference to presently preferred embodiments (by way of example, and not of limitation). The present application describes several embodiments, and none of the statements below should be taken as limiting the claims generally.

For simplicity and clarity of illustration, the drawing figures illustrate the general manner of construction, and description and details of well-known features and techniques may be omitted to avoid unnecessarily obscuring the invention. Additionally, elements in the drawing figures are not necessarily drawn to scale, some areas or elements may be expanded to help improve understanding of embodiments of the invention.

The terms "first," "second," "third," "fourth," and the like in the description and the claims, if any, may be used for distinguishing between similar elements and not necessarily for describing a particular sequential or chronological order. It is to be understood that the terms so used are interchangeable. Furthermore, the terms "comprise," "include," "have," and any variations thereof, are intended to cover non-exclusive inclusions, such that a process, method, article, apparatus, or composition that comprises a list of elements is not necessarily limited to those elements, but may include other elements not expressly listed or inherent to such process, method, article, apparatus, or composition.

It is contemplated and intended that the design apply to both heavy duty tools and lightweight tools and be made of any suitable materials; for clarity reason, the examples show toolbox having clamps and holders for holding multiple wrench sets, but an ordinary person in the art would know the variations to modify the design to hold other types of tools. The clamps and individual holding racks are well known in the art and therefore the exact structures for the clamps and tool-holding racks for gripping the tools are omitted.

In reference to FIGS. 1A, 1B, 1C, and 1D, toolbox 100 capable of disassembly is shown. Toolbox 100 includes distinctly five functionally and structurally independent parts that can be disassembled and re-assembled: a supportive holding frame 101 that has two separated standing sections 103 and two separated holding sections 105, two sliding-racks 108 capable of gliding into holding sections 105, two projectable lift-rack-arms 115 anchored at middle section wall 117 of holding frame 101. Holding sections 105 are constructed with two separated pieces of supporting boards, forming the supportive bottom for sliding-racks 108. Standing sections 103 are configured in two wing-like box structures, providing the necessary standing base for the toolbox. The two wing-like structures 103 are connected with middle section wall 117 and are separated by the two bottom supporting boards of holding sections 105 where the two bottom supporting boards 105 are likewise adjoined by wall 117 in the middle of the holding frame 101. As shown in the transparent drawings in FIG. 1D and FIG. 2A, the two wing-like structures 103 are constructed in 3D-box style with walls and void inside (FIG. 2A) which minimizes the total weight of the toolbox.

Figure 2A:
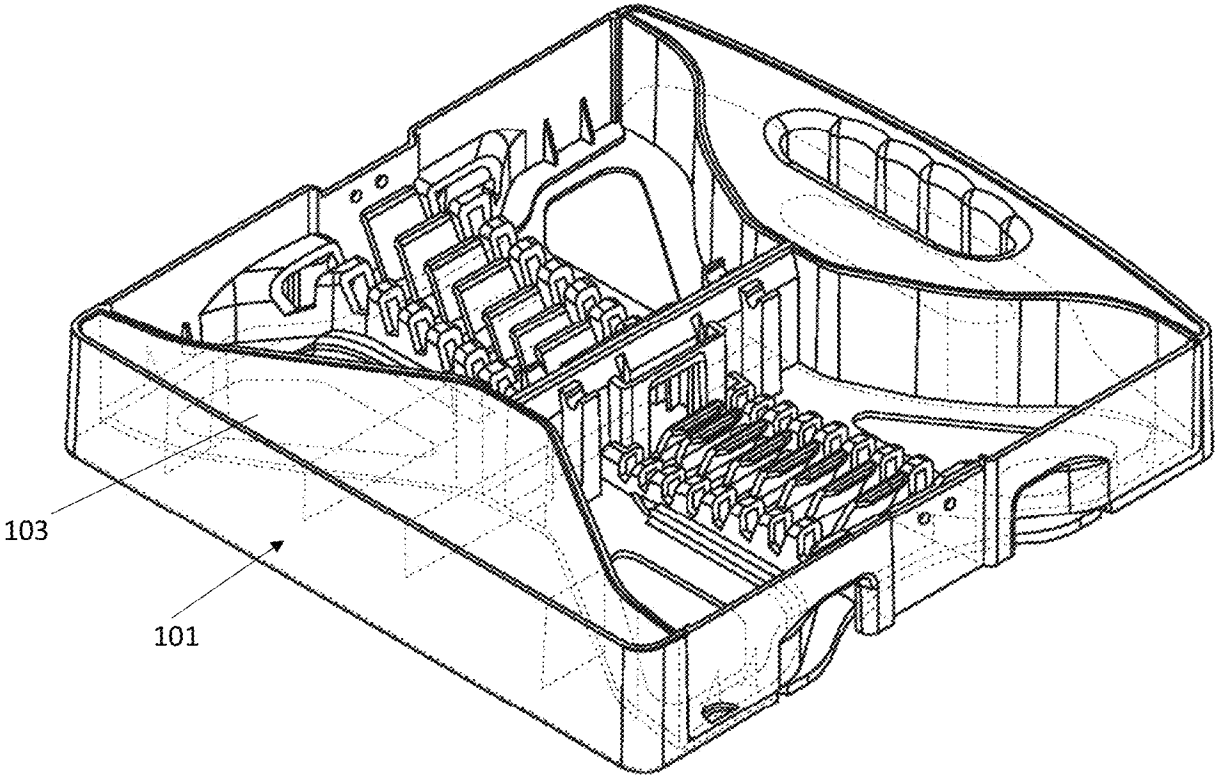
FIG. 2A is a transparent perspective view of the bottom portion of an example toolbox in accordance with this application.

As shown in FIG. 1A, wing-like structures 103 are comprised of two symmetrically shaped three dimensional bird-wing structures where the spreading sides form the left and right side walls 116 and side edges 110 of toolbox 100, providing a stable and balanced standing support for the whole toolbox. Between the wing-spreads 103 are the two bottom-boards 105 that respectively adjoin with both of the two wing structures 103, forming two butter-fly shaped spaces for mounting sliding-racks 108. Each individual bottom-board 105 is also configured with triangular apertures 112 at its side sections which carve out the unnecessary weight, but still retains the supporting strength. The middle section 106 of bottom-board 105 is configured with multiple parallel slotted apertures 114 for minimizing weight as well as a pair of horizontal sliding tracks 107 for gliding in and holding a sliding-rack 108. Sliding-racks 108 in turn are configured with clamp racks 111 for holding and organizing tools.

Figure 1B:
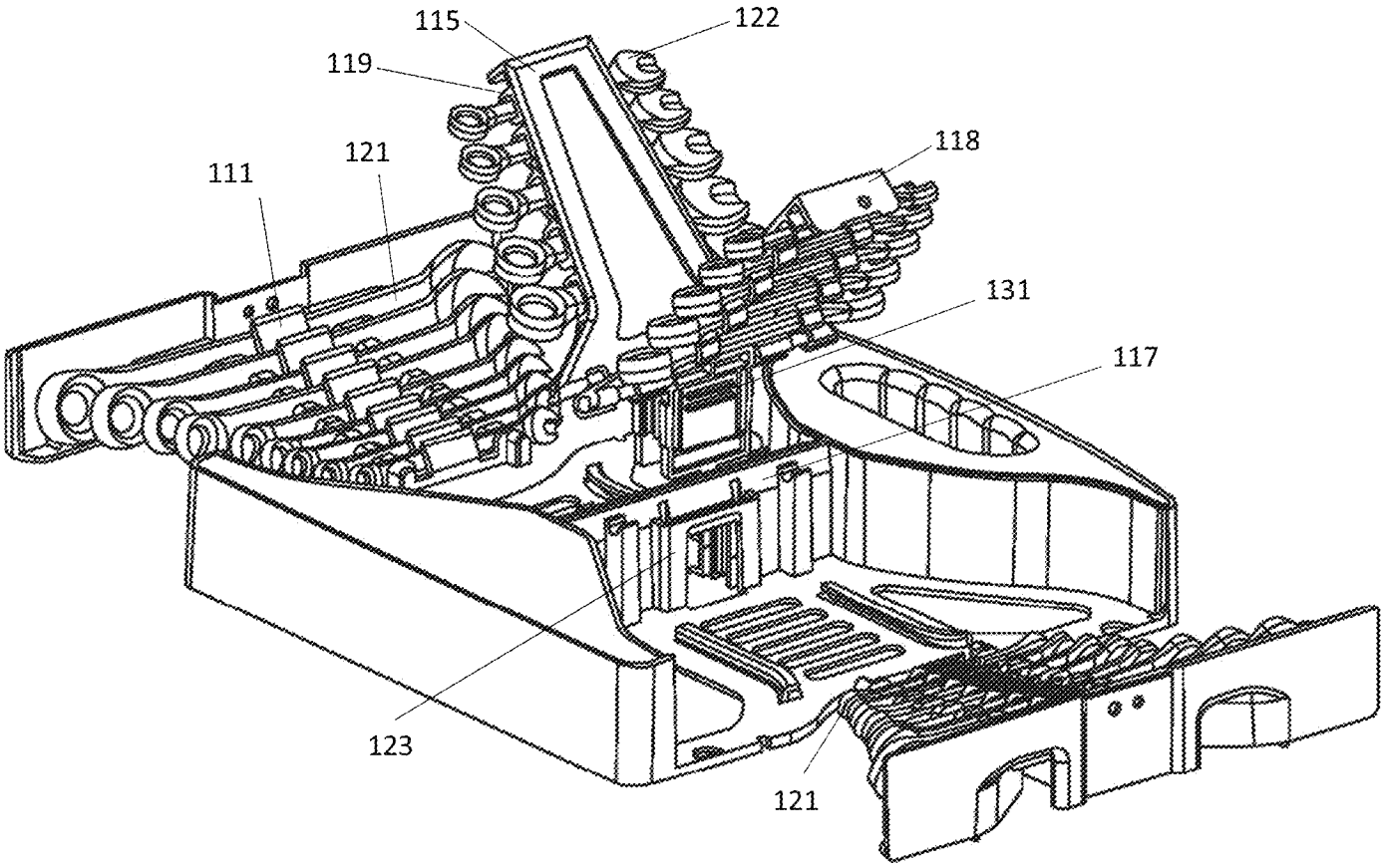
FIG. 1B is a perspective view of an example functioning toolbox filled with tools in accordance with this application.
Figure 2B:
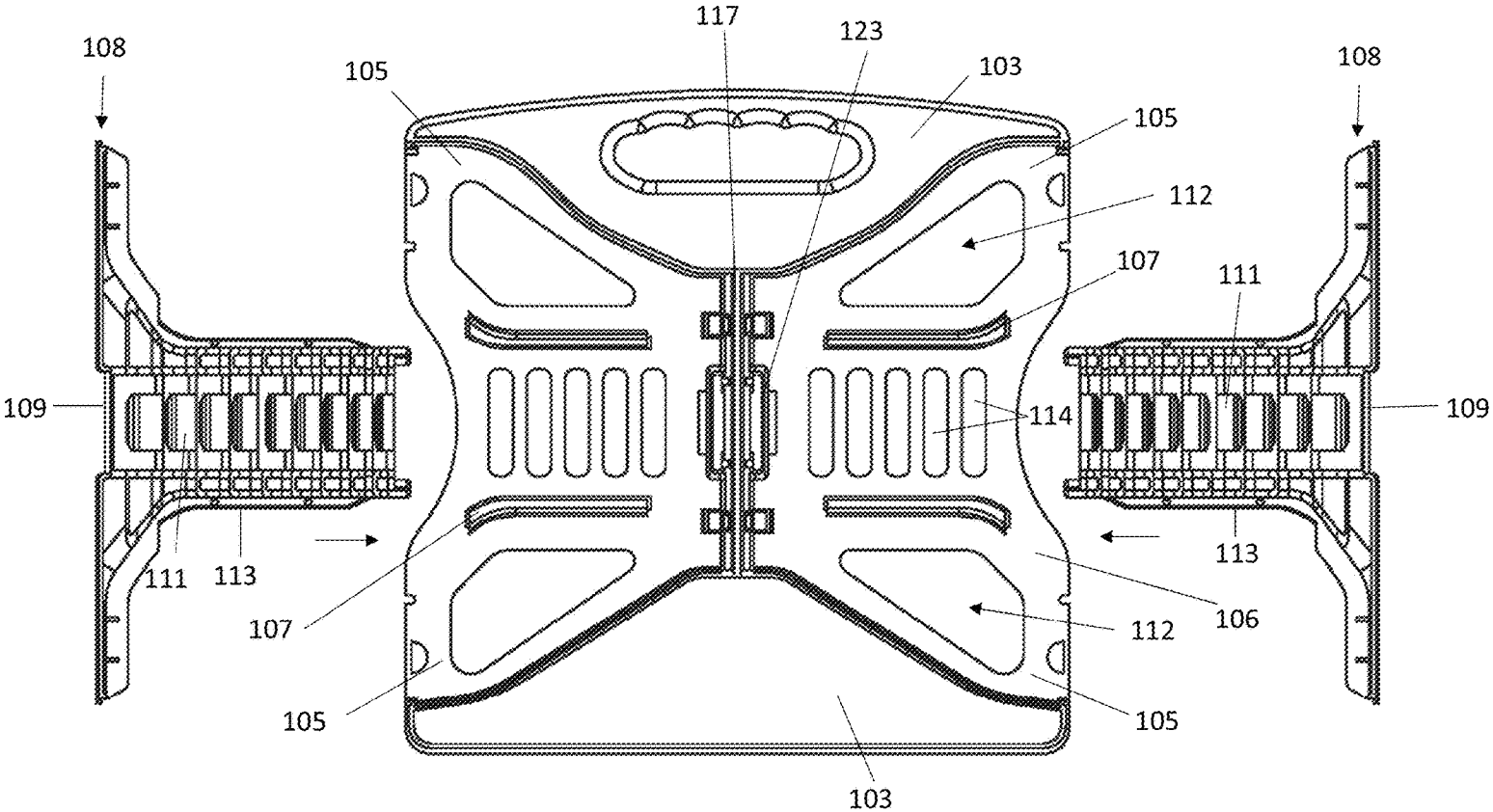
FIG. 2B is a top view of the disassembled bottom portion of an example toolbox in accordance with this application.
Figure 2C:
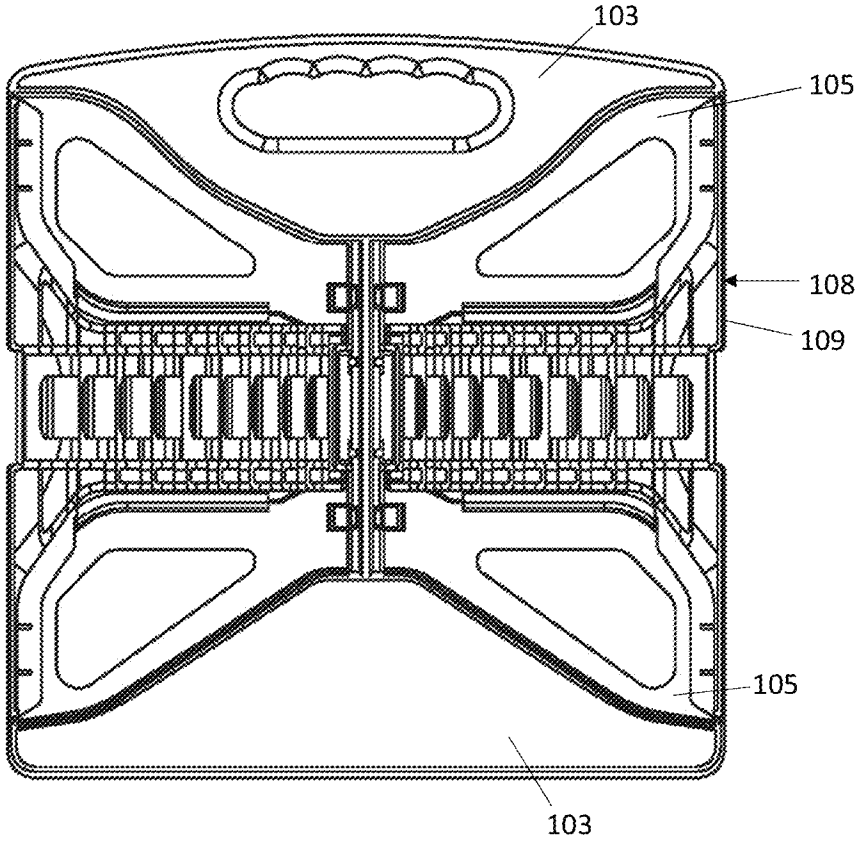
FIG. 2C is a top view of the assembled bottom portion of an example toolbox in accordance with this application.

Viewing from the top, as shown in FIG. 2B, the two bottom-board sections 105 are shaped like the wings of a butter-fly, and each sliding-rack 108 is constructed in T-shape with a breadth piece 109 for being an openable wall of the toolbox and a depth piece 113 for having tool-racks 111 for holding tools 121 (shown in FIG. 1B). FIG. 2C shows the top view of the bottom section when sliding-racks 108 have glided into glide tracks 107 and are packed inside holding frame 101.

Figure 1C:
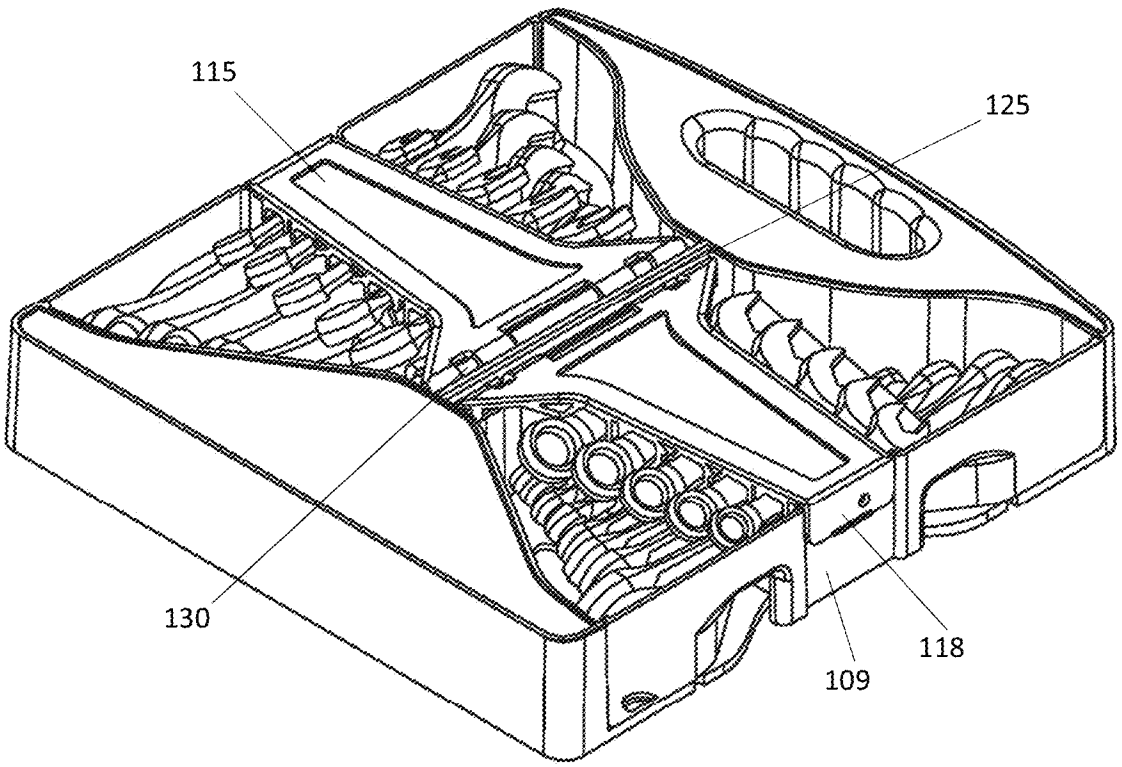
FIG. 1C is a perspective view of an example locked toolbox filled with tools in accordance with this application.
Figure 1D:
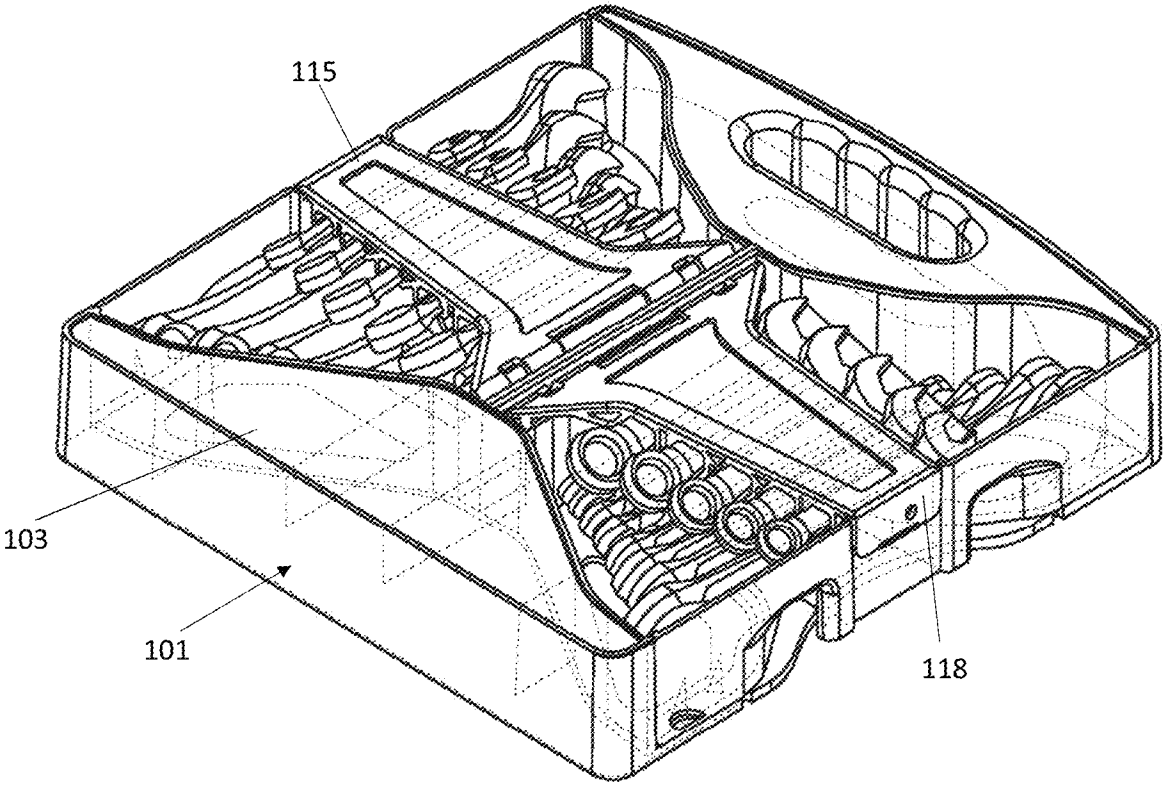
FIG. 1D is a transparent perspective view of an example locked toolbox filled with tools in accordance with this application.

Also shown in FIG. 1A, projectable lift-rack-arms 115 are configured with a hinge mechanism 124, 130 and 131 that are anchored inside middle section wall 117. Lift-rack-arms 115 are configured with rows of tool-racks 119 for holding tools 122 (shown in FIG. 1B). In FIG. 1C, a locking mechanism 118 locks unto breadth piece 109. When the hinge fins 131 are pressed down, lift-rack-arms 115 would cover the bottom portion and lock the toolbox as shown in FIG. 1C.

Figure 3A:
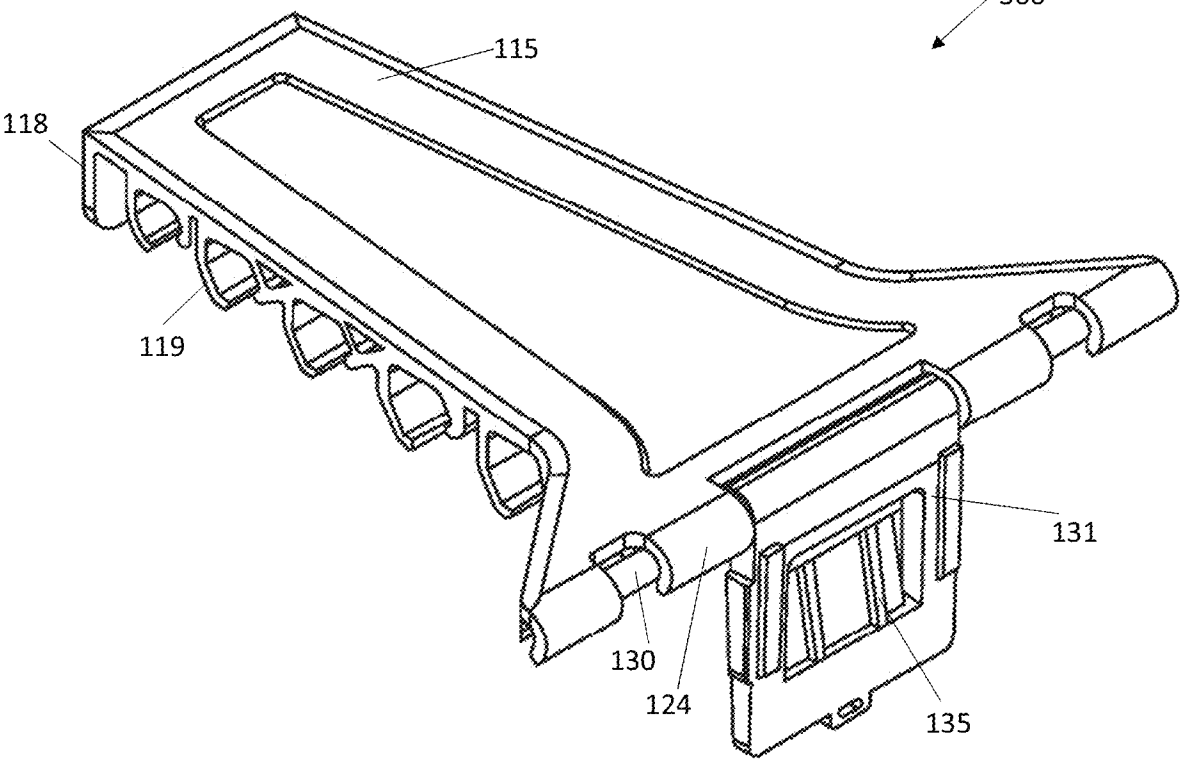
FIG. 3A is a perspective view of an example lift-rack-arm in accordance with this application.
Figure 4:
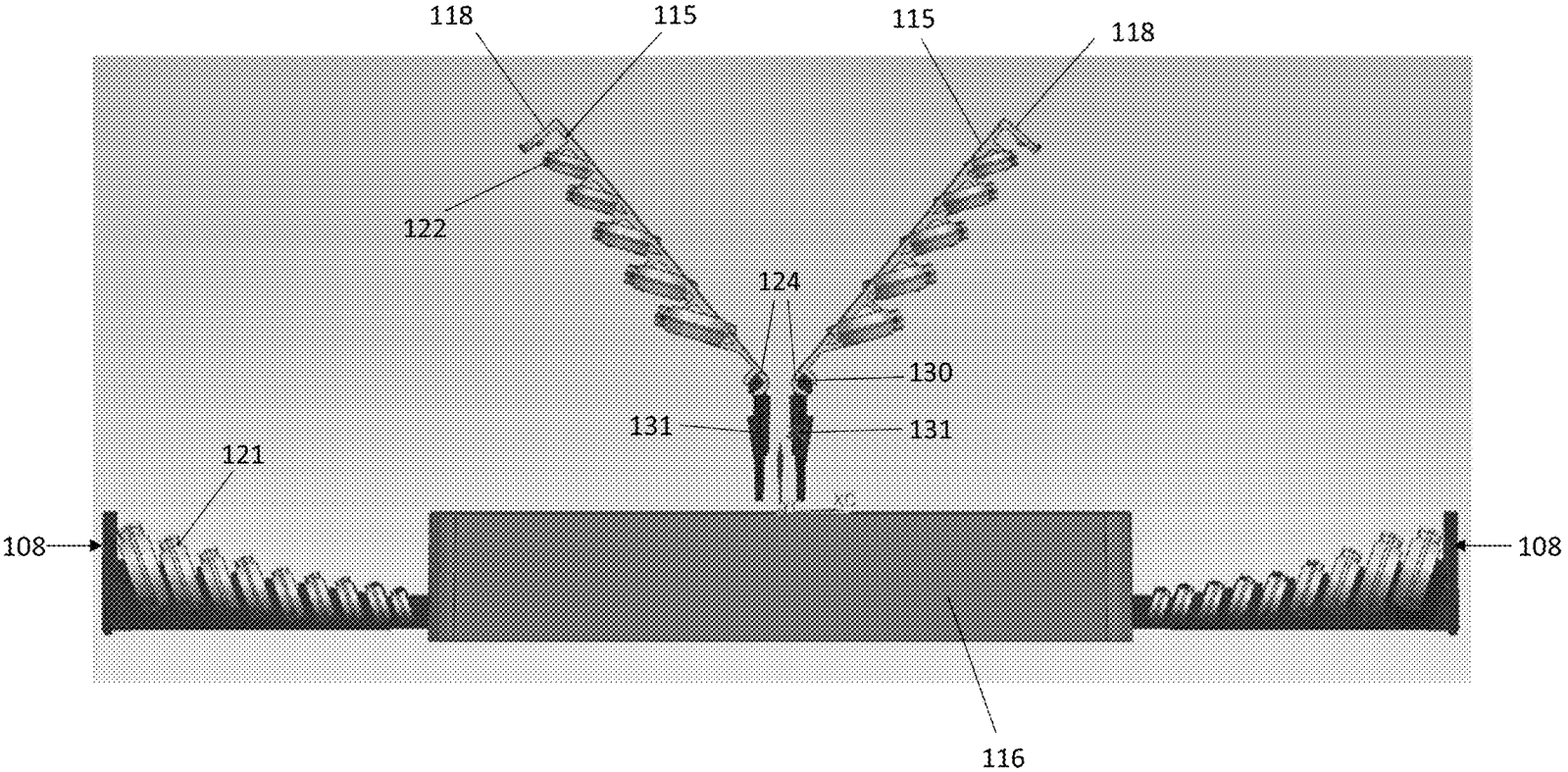
FIG. 4 is a front section view of a disassembled toolbox in accordance with this application.

The structure of the lift-rack-arm is further shown in reference to FIG. 3A and FIG. 4. Left lift-rack-arm piece 300 includes a scraper-like body piece 115 that is built with multiple tool-holding clamp rack sets 119 on the underneath side. The length of scraper-like body piece 115 matches that of depth piece 113 shown in FIGS. 1A and 1C. A locking side piece 118 is built at the end of body piece 115 to interact with the breadth piece 109 and lock the toolbox. Hinge mechanism includes hinge joint 124 and hinge rod 130 mounted with a spring mechanism and a heavy-duty continuous hinge fin 131 in the middle that will propel the scraper-like body 115 upwards when the hinge fin 131 is released out from the vertical holding pocket on the middle wall of the toolbox as shown in FIG. 1A and FIG. 1B. After hinge fin 131 is released, the up-lifted lift-rack-arms 115 then project upwards in the air for easy access to the tools on the racks (as shown in FIG. 1B). Hinge fin 131 is configured with a locking mechanism 135 that fits into pocket construct 123 on the middle section wall 117 shown in FIG. 1B.

Figure 3B:
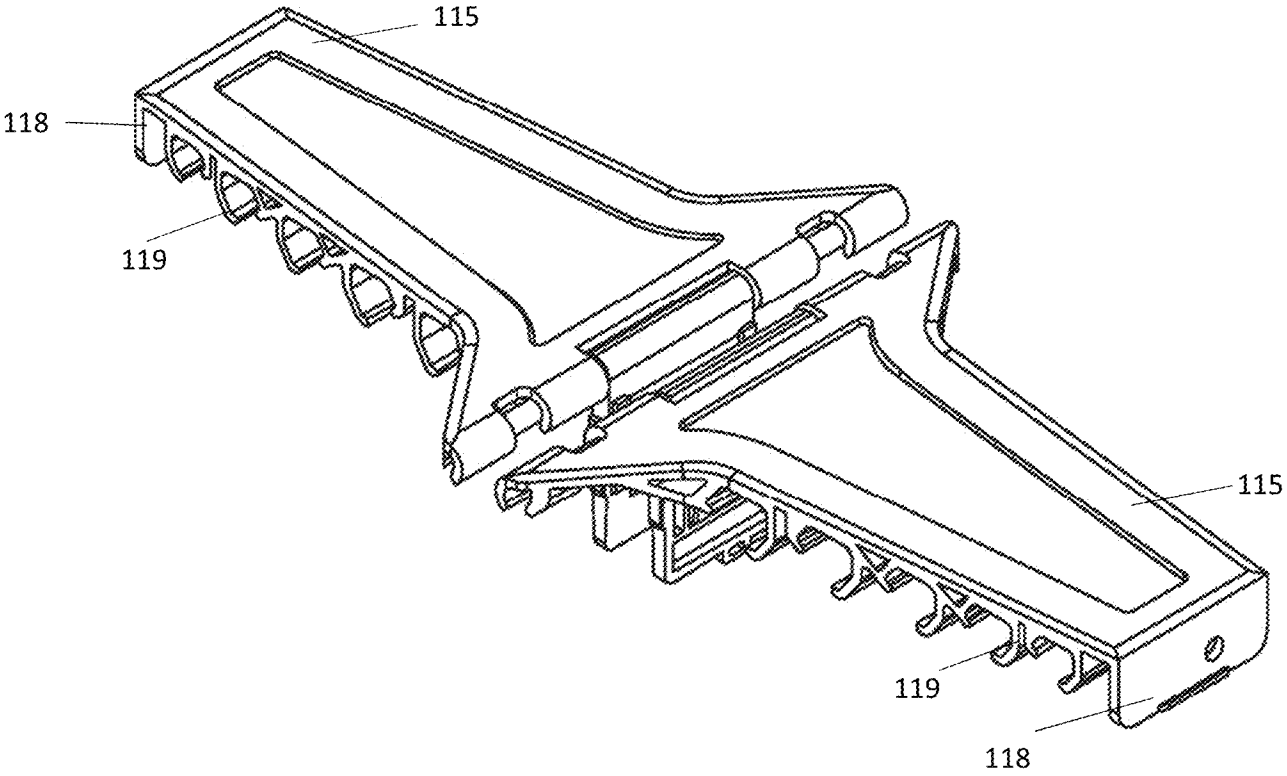
FIG. 3B is a perspective view of the left and right lift-rack-arms in accordance with this application.

In reference to FIG. 3B, it shows how the identical left and the right lift-rack-arm pieces 115 are arranged together to function as a cover for toolbox 100. FIG. 4 shows a side view of the toolbox when the two sliding-racks 108 and the two projective lift-rack-arms 115 are released from the toolbox. The stored tools 121 and 122 are exposed for easy access.

Figure 5:
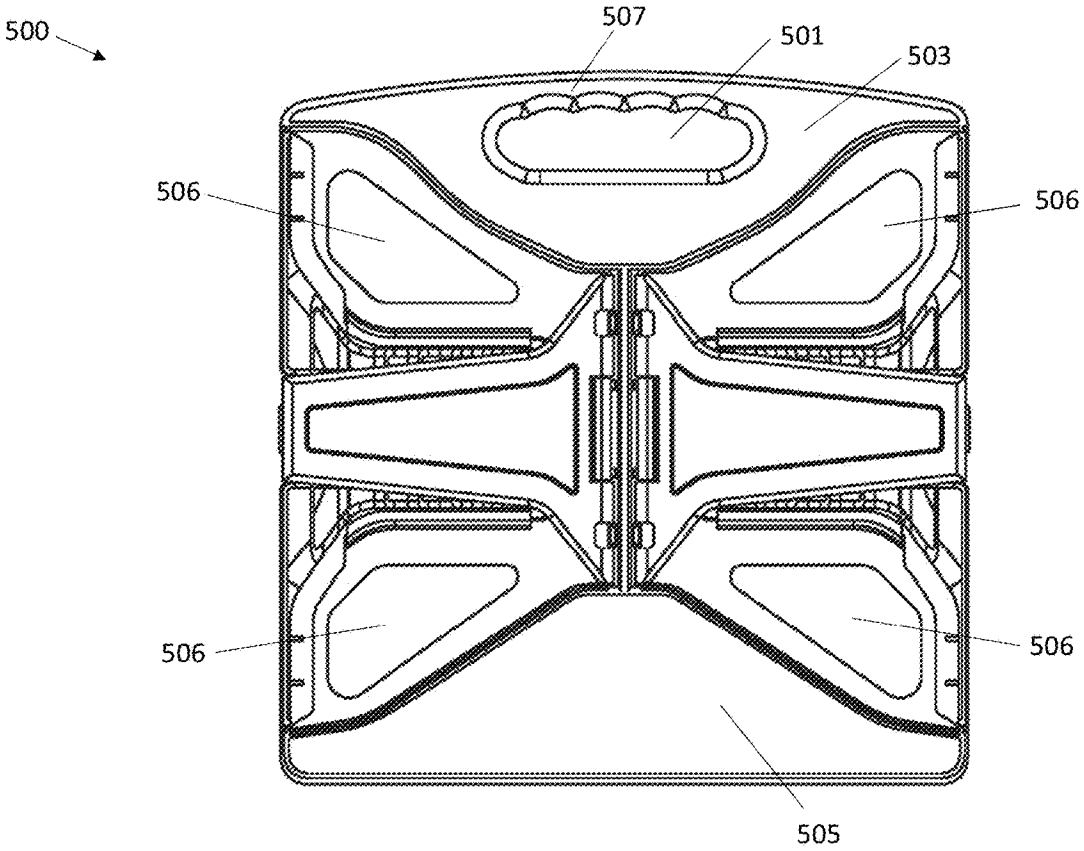
FIG. 5 is a top view of a locked toolbox in accordance with this application.

In reference to FIG. 5, a top view of an example toolbox 500 in locked position is shown when all the racks are placed inside the box. Toolbox 500 is configured with a plurality of carved apertures 506 are triangular in shape that may be positioned symmetrically on the supporting boards. Preferably the balanced standing sections 503 and 505 are void inside and are shaped like two symmetrically wing-spreads. The triangular apertures 506 on the supporting boards may thus look like a pair of butterfly wings. In addition, aperture 501 is configured within standing box section 503 which shapes into a handle 507 to carry the toolbox. The triangular apertures 506 on the supporting boards 105 allow the board frame retain sufficient supportive strength of the remaining frames.

Figure 6:
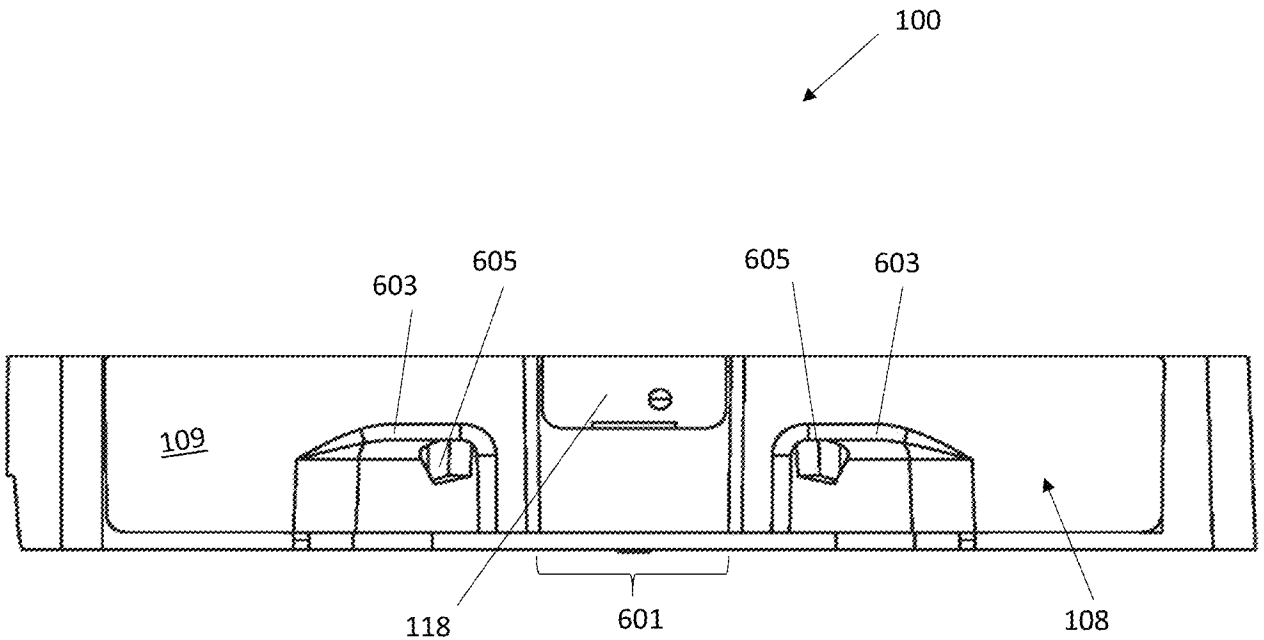
FIG. 6 is a front view of a locked toolbox in accordance with this application.

In reference to FIG. 6, an example front view of the embodied toolbox is shown. The breadth piece 109 of sliding-rack 108 is configured with section 601 that matches with the locking side piece 118 of the lift-rack-arm 115 (not shown in the figure). Any suitable traditional locking mechanism may be configured with the locking side piece 118 in order for lift-rack-arm 115 to function as a cover of toolbox 100. For example, there may be a press-down snatching mechanism or a switch-and-lock mechanism. In addition, releasing triggers 605 may be configured in a carved-in gripping box 603 for releasing sliding-rack 108 from its holding position to the sliding position to be pulled out as shown in FIG. 1A.

As will be recognized by those skilled in the art, the innovative concepts described in the present application can be modified and varied over a tremendous range of applications, and accordingly the scope of patented subject matter is not limited by any of the specific exemplary teachings given. It is intended to embrace all such alternatives, modifications and variations that fall within the spirit and broad scope of the appended claims.

Additional general background, which helps to show variations and implementations, may be found in the following publications, such as U.S. Pat. No. 6,276,735, all of which are hereby incorporated by reference herein for all purposes.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

The claims as filed are intended to be as comprehensive as possible, and NO subject matter is intentionally relinquished, dedicated, or abandoned.

What is claimed is:

1. A dynamic toolbox, comprising:

a supportive holding frame having rectangular four sides, wherein a pair of standing sections are configured at two opposite said sides and a first supportive board and a second supportive board are configured at two opposite said sides, said first supportive board and second supportive board are adjoined by a middle section wall, and each of said first supportive board and said second supportive board is configured with a respective middle section having a pair of gliding tracks;

a pocket construct being configured on said middle section wall;

a sliding-rack piece having a breadth piece and a depth piece, said depth piece having a plurality of tool-racks, being configured to slide into said first supportive board via said pair of gliding tracks; and a lift-rack-arm configured with a plurality of tool-racks, being anchored by a hinge fin inside said mounting pocket on said middle section wall.

2. The dynamic toolbox of claim 1, wherein said breadth piece of said sliding-rack piece forms an openable side wall of said toolbox when sliding into said pair of gliding tracks.

3. The dynamic toolbox of claim 1, wherein said first board and said second board contain tri-angular apertures.

4. The dynamic toolbox of claim 1, wherein said lift-rack-arm has a locked position and a released position, and said lift-rack arm forms a cover of said toolbox when pressing down to said locked position.

5. The dynamic toolbox of claim 1, wherein said lift-rack-arm has a locked position and a released position, and said lift-rack arm lifts out of the toolbox and exposes its plurality of tool-racks at said released position.

6. The dynamic toolbox of claim 1, wherein each of said middle sections on said first supportive board and said second supportive board is slotted with a plurality of parallel apertures.

7. The dynamic toolbox of claim 1, wherein said pair of standing sections of said supportive holding frame are symmetrically shaped like spreading wings.

8. The dynamic toolbox of claim 7, wherein an aperture is configured within one of said pair of standing sections, forming a handle for carrying said toolbox.

* * * * *